United States Patent [19]

Shiro

[11] 4,092,823

[45] June 6, 1978

[54] TIMEPIECE HAVING DISPLAY CYLINDERS

[75] Inventor: Sonobe Shiro, Tokyo, Japan

[73] Assignee: Sansho Co., Ltd., Tokyo, Japan

[21] Appl. No.: 654,118

[22] Filed: Feb. 2, 1976

[30] Foreign Application Priority Data

Feb. 10, 1975 Japan ..... 50-17720

[51] Int. Cl.[2] ..... G04B 45/00; G04B 19/02; G04B 19/02

[52] U.S. Cl. ..... 58/125 C; 58/2; 58/127 R

[58] Field of Search ..... 58/1, 2, 125 C, 127 R

[56] References Cited

U.S. PATENT DOCUMENTS

| | | | |
|---|---|---|---|
| 2,243,343 | 5/1941 | Johnson | 58/125 C |
| 2,762,190 | 9/1956 | Holzner | 58/23 R |
| 3,587,222 | 6/1971 | Mestrovic | 58/2 |
| 3,702,531 | 11/1972 | Maue | 58/127 R |

*Primary Examiner*—Edith S. Jackmon
*Attorney, Agent, or Firm*—Spensley, Horn & Lubitz

[57] ABSTRACT

At least one cylinder driven at a constant speed is contained in a casing and a dial plate mounted on the casing is provided with a window extending in the direction of the cylinder. The upper edge of the window is marked with digits. The outer periphery of the cylinder is divided into two sections by a line inclined a definite angle with respect to the axis of the cylinder, and the two areas are coloured by different colours. The inclined line cooperates with the digits to display time. When two or three cylinders are used it is possible to display hours, minutes and seconds.

5 Claims, 8 Drawing Figures

TIMEPIECE HAVING DISPLAY CYLINDERS

BACKGROUND OF THE INVENTION

This invention relates to a timepiece and more particularly to a timepiece capable of displaying time without using any time, minute and second hands.

With recent advance in the art of electronics, driving systems of various type have been developed for driving timepieces. Such developments can be classified into two types, one directed to display time at extremely high accuracies and the other directed to develope timepieces of good design. The invention relates to a timepiece of the latter type. In an analogue timepiece utilizing a relatively large dial plate such as an ordinary clock or a wall clock it is possible to directly read the time. However, in such a clock a long and a short hands radially extending from the center of the dial plate and in some cases a second hand is provided for displaying hours, minutes and seconds. Accordingly, when viewed at a glance or viewed from a remote point, reading of the time is often mistaken. This is especially true when the hands are read in the dim light.

SUMMARY OF THE INVENTION

Accordingly, it is an object of this invention to provide an improved timepiece capable of preventing misreading of the displayed time.

Another object of this invention is to provide a timepiece having a construction as simple as the conventional analogue timepiece utilizing hour and second hands.

A further object of this invention is to provide a timepiece including a driving mechanism capable of intermittently driving the hour cylinder and quickly returning the hour and minute cylinders to zero positions.

Accoring to this invention, there is provided a timepiece comprising a casing, at least one cylinder contained in the casing, driving means for rotating the cylinder at a constant speed, and a dial plate mounted on the casing, the dial plate being provided with a window extending in the axial direction of the cylinder, the outer periphery of the cylinder being divided into two areas by a line inclined a definite angle with respect to the axis of the cylinder, and the two areas being coloured by different colours. Time display digits for example 0 to 12 are marked on the upper edge of the window. As the cylinder rotates, the line moves from one end to the other end of the window whereby the time can be readily read by the cooperation of the inclined line and the digits. When two cylinders are provided and one is driven to make one revolution per 12 or 24 hours and the other per 60 minutes it is possible to display hours and minutes. If desired, another cylinder displaying seconds may be added a lamp may be installed in each window or between the windows to facilitate reading of the displayed time.

In a modified driving mechanism, the driving means comprises means for continuously driving the minute cylinder and for intermittently driving the hour cylinder and means for quickly returning the hour and minute cylinders to zero positions when 12 o'clock and 60 minute positions have been reached.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
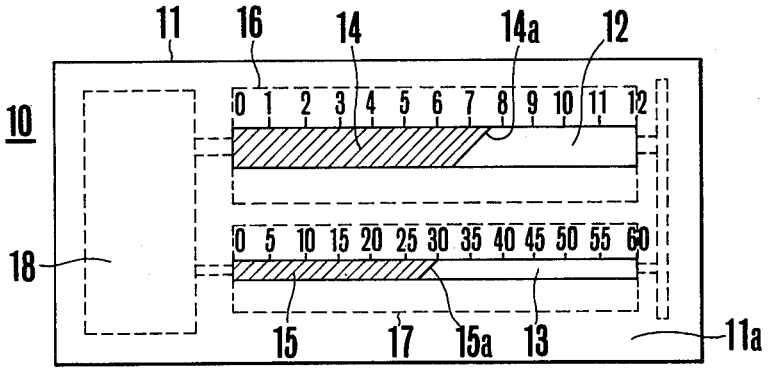
FIG. 1 is a front view of a timepiece embodying the invention.

One example of the timepiece 10 shown in FIG. 1 comprises a casing 11, and a dial plate 11*a* on the front surface of the casing. Two narrow longitudinal windows 12 and 13 are provided through the dial plate 11*a*. Digits 0 to 12 inclusive are printed or stamped as equal spacings along the upper edge of the upper window 12 for utilizing this window to display hours.

Thirteen digits 0, 5, 10 . . . 60 are printed or stamped at equal spacings along the upper edge of the lower window 13 for utilizing this window to display minutes. Shadings 14 and 15 are provided on the peripheries of the cylinders 16 and 17 respectively to be viewable through windows 12 and 13. These shadings are used to display hours and minutes. In the position shown in FIG. 1 they display 7 o'clock 30 minutes. The cylinders 16 and 17 are driven by a driving mechanism 18 to make one revolution in 12 hours and 60 minutes respectively. The detail of the construction of the cylinders 16 and 17 and the driving mechanism 18 is shown in FIGS. 2 and 3.

Figure 2:
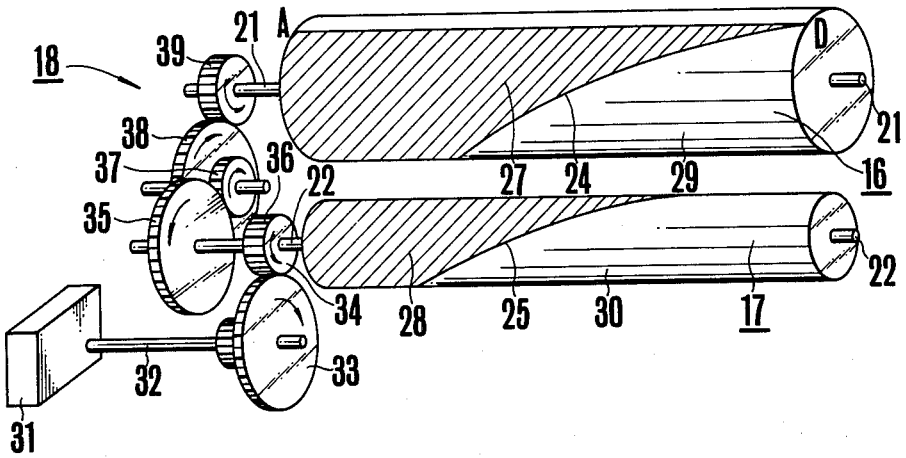
FIG. 2 is a perspective view of the cylinders shown in FIG. 1 and a driving mechanism for driving the cylinders.
Figure 3:
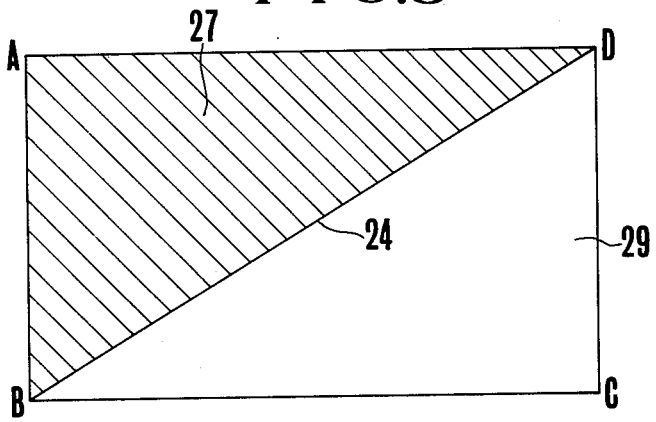
FIG. 3 is a developmental view of one cylinder shown in FIG. 2.

As shown in FIG. 2, cylinders 16 and 17 are supported by shafts 21 and 22, respectively, which are coupled to the driving mechanism 18 in a manner to be described hereunder. Although in FIG. 2 these cylinders 16 and 17 are shown to have different diameter, it will be clear that they may have the same diameter. To form the shadings 14 and 15 shown in FIG. 1 on the outer peripheries of cylinders 16 and 17 lines 24 and 25 inclined at definite angles with respect to the axes of the shafts 21 and 22 are drawn on the peripheries. These inclined lines divide the peripheral area of the cylinders 16 and 17 into two areas, respectively. The areas 27 and 28 to the left of lines 24 and 25 are coloured red, for example, (or shaded with black ink) whereas areas 29 and 30 to the right are coloured white. FIG. 3 shows a developmental view of cylinder 16 which shows more clearly the pattern described above. More particularly, when the periphery of cylinder 16 is developed along a longitudinal line AD, a rectangle ABCD is obtained. The line 24 is drawn along a diagonal BD, and the area ABD is coloured red whereas the area BCD is coloured white.

When the cylinders 16 and 17 are coloured or shaded as above described, as they rotate the shadings 14 and 15 are looked as if they move from left to right when they are viewed through windows 12 and 13.

The driving mechanism 18 comprises a source of drive 31 such as an electric motor, a spring motor, or the like for driving a shaft 32 at a constant speed. The shaft 32 carries a pinion 33 that drives a gear 34 secured to the shaft 22 of cylinder 17, thus rotating the cylinder 17 in the counterclockwise direction to make one revolution per hour. Thus, the shading 15 appears at the left-hand end of the window 13 at each hour and gradually extends toward right.

The shaft 22 also carries a pinion 35 which is coupled to a gear 39 secured to the shaft 21 of cylinder 16 via a gear 37 and a pinion 38 which are secured to an intermediate shaft 36, thus rotating the shaft 21 in the counterclockwise direction to make one revolution per 12 hours. In this manner, the cylinder 16 is rotated one revolution in 12 hours. The shading 14 appears at the left-hand end of window 13 at each 12 hours and gradually extends toward right as the cylinder 16 rotates.

In this manner, the time is displayed by the shadings or the extent of the shaded areas. Accordingly, it is possible to correctly determine the displayed time at a glance and even when the displayed time is read from a remote position there is no fear of misreading as in the conventional clock utilizing hour and minute hands.

Although in the foregoing description, one of the areas of each cylinder was coloured red or shaded it is possible to substitute any other colour (for example yellow) for red and white.

To make easy observation of the shaded areas, lamps may be disposed within respective windows 12 and 13. To attain the same object a single lamp may be disposed within the casing 11 between windows 12 and 13.

To make easier observation of the shaded areas, the cylinders 16 and 17 may be made of transparent plastic or glass, and coloured or shaded areas, in which case lamps are contained in respective cylinders.

Instead of rotating cylinder 16 one revolution per 12 hours it may be rotated one revolution per 24 hours. In this case, digits 1, 2, . . . 24 are marked at equal spacings along the upper edge of window 12 of the dial plate.

Instead of marking digits along the upper edge of the window 12 starting from 0 any digits may be marked. When the display of the time may rough some of the digits may be omitted. For example only digits 0, 3, 6, 9, 12 may be used.

Although, in the foregoing embodiment, marks have been graduated in the upper edge of respective windows 12 and 13, they may be done so in the lower edges or alternatively, an alternate graduation of individual marks in the upper and lower edges of a single window may be possible.

As will as described later in connection with FIG. 4, 12 digits on the upper edge of the window 12 may not be spaced equally.

Figure 4:
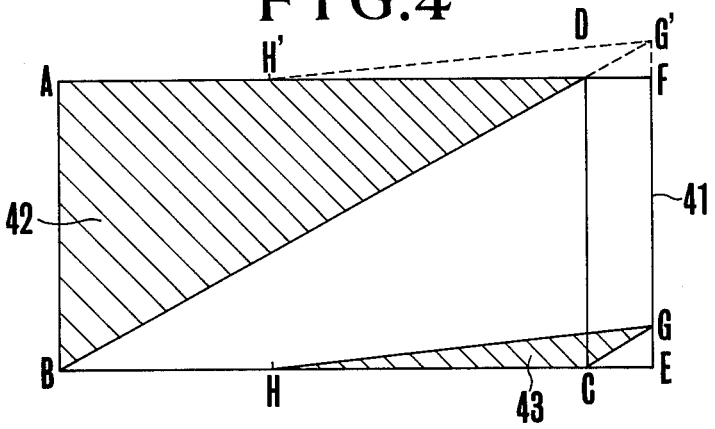
FIG. 4 is a similar developmental view showing a modified timepiece of this invention.

FIG. 4 shows a developmental view of a modified cylinder. In the construction shown in FIG. 1, after the right-hand ends 14*a* and 15*a* of the shadings 14 and 15 have reached 12 o'clock and 60 minute positions respectively, when the cylinders 16 and 17 are rotated further, white portions increase gradually from the upper portions toward the lower portions of the windows 12 and 13, while at the same time the shaded areas gradually appear at the lefthand ends of respective windows, that is at the 0 o'clock and 0 minute positions thereof. However, such time is more difficult to read than other times. This is especially true where the cylinder 16 is rotated at a lower speed for displaying hours.

In the modification shown in FIG. 4 the length of cylinder 41 is made longer than that of cylinder 16 shown in FIG. 1 for a length corresponding to one hour, and the axial length of window 12 is also increased correspondingly. Accordingly, the cylinder 16 is represented by ABCD, whereas the elongated cylinder 41 is by ABEF, and DF or CE represents a portion corresponding to one hour. Coloured area ABD(42) is used to display 12 hours. A cross-point G' is obtained by extending a diagonal BD and extending the end line EF of cylinder 41. Then this point G' is connected to a point H' arbitorarily selected on line AD. A line HG parallel to H'G' is drawn between a point H on line BC and a point G on line EF to form a form a triangle HCG which is coloured. The upper edge of the window 12 is marked with minute display digits at portions corresponding to added length DF. With this construction, after 12 o'clock has been reached the right-hand end of the shaded area extends further to the right of line CD and cooperate with said minute display digits and as the width of the coloured area has been increased by triangle HCG, the area of the white portion is decreased. During this interval, the shaded areas appear at the left-hand ends of the windows. Accordingly, the user can read the displayed time either in terms of 12 o'clock, X minutes or 0 o'clock, X minutes. Although in this embodiment the extension CE(DF) of the cylinder was made to correspond to 1 hour, the extension may be made to correspond to any internal of time.

Figure 6:
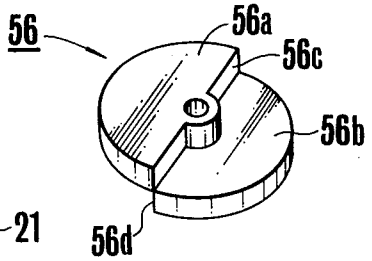
FIG. 6 is a perspective view showing the continuously rotating cam shown in FIG. 5.
Figure 5:
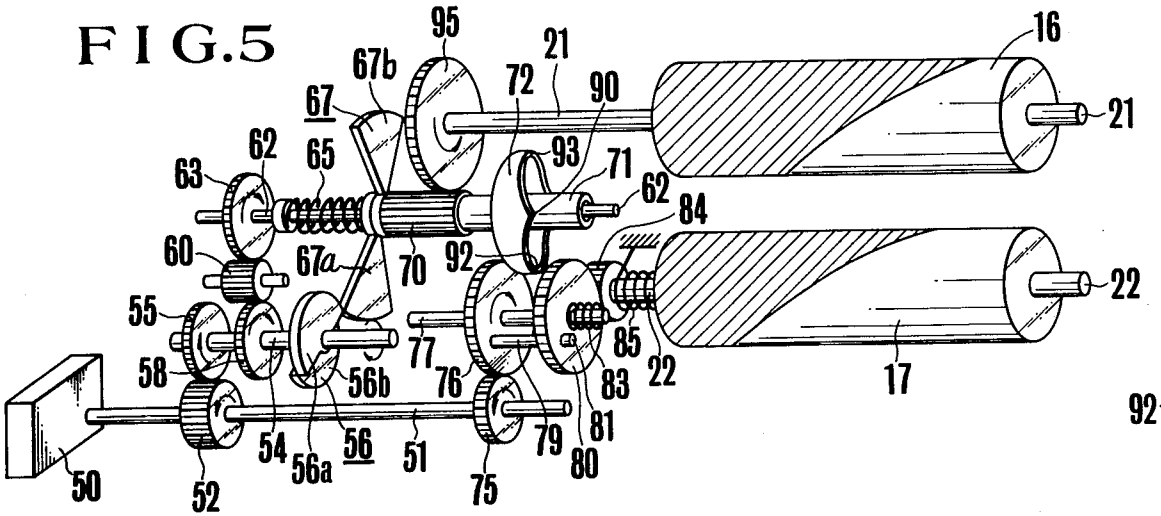
FIG. 5 is a perspective view similar to FIG. 2 showing still another embodiment of this invention.

FIG. 5 shows a modified driving mechanism in which reading of the time after the righthand ends 14*a* and 15*a* of the shaded areas 14 and 15 shown in FIG. 1 have reached 12 o'clock or 60 minutes position is made easier. The rotation of the driving mechanism 50 is transmitted to a continuously rotated cam wheel 56 secured on a shaft 54 through a pinion 52 secured to shaft 51 of the driving mechanism and a gear 55 secured to shaft 54. The rotation of shaft 54 is transmitted to a rotating shaft 62 through a gear 58 secured to the shaft 54, an idle gear 60 and a gear 63 secured to shaft 62. A spring 65 is interposed through shaft 62 between the gear 63 and an intermittently rotating cam wheel 67 rotatably mounted on shaft 62. In the example shown, the intermittently rotating cam wheel 67 comprises two sector shaped cam member 67*a* and 67*b* which are mounted symmetrically with respect to shaft 62 at different axial positions. In other words, the cam member 67*b* is positioned to the left of the cam member 67*a*. These cam members are disposed to engage the continuously rotating cam wheel 56 described above. As shown in FIG. 6 the continuously rotating cam wheel 56 comprises two semicircular plates 56*b* and 56*a* displaced axially in the same manner as the cam members 67*a* and 67*b* of the intermittently rotating cam wheel 67. Thus, the edge 56*c* of the semicircular plate 56*a* is disposed to engage the cam member 67*a* whereas the edge 56*d* of the semicircular plate 56*b* to engage the cam member 67*b*. As shown in FIG. 5, the intermittently rotating cam wheel 67 is connected to a pinion 70, a hollow shaft 71 and a bell shaped cam 72 which are rotatably mounted on the rotating shaft 62 in the same manner as the cam wheel 67.

On the other end of the constantly rotating shaft 51 is secured a pinion 75 which meshes a gear 76 secured to a shaft 77. A pin 79 parallel with shaft 77 is secured to one side of the gear 76. Further, a gear 80 is rotatably mounted on the shaft 77 and the gear 80 is provided with hole 81 for receiving pin 79. Normally, two gears 76 and 80 are combined integrally by a compression spring 83 mounted on shaft 77 on the outer side of gear 80. The gear 80 meshes a pinion 84 mounted on the shaft 22 for driving the minute display cylinder 17. The shaft 22 is surrounded by a spring 85 with one end secured to a stationary member, for example the chassis of the clock and the other end to one end of the cylinder 17.

Figure 7:
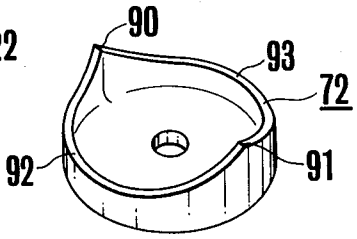
FIG. 7 is a perspective view of a bell shaped cam utilized in the modification shown in FIG. 5.

As shown in FIG. 7, the bell shaped cam 72 comprises two projections or high portions 90 and 91 spaced 180° and two low portions 92 and 93 between the high portions and is mounted on hollow shaft 71 such that when the bell shaped cam is maintained standstill, its low portions 92 and 93 will not engage the gear 80. However, when one of the projections 90 and 91 of the bell shaped cam engages the gear 80, the gear 80 will be freed from pinion 76 as will be described later. As shown, pinion 70 is disposed to mesh a gear 95 mounted on one end of the shaft 21 of the hour display cylinder 16.

The driving mechanism shown in FIG. 5 operates as follows. When the righthand end 15*a* of the shaded portion of the minute drum 17 reaches 60 minute position the intermittently rotating cam wheel 67 disengages from the continuously rotating cam wheel 56 and the cam wheel 67 is rotated rapidly 180° by the spring 65 with the result that pinion 70 is also rotated quickly. The rotation of pinion 70 is reduced by gear 95 to rotate the hour cylinder 16 by 30°. At this time the bell shaped cam 72 is also rotated so that either one of the projections 90 and 91 engages one side of gear 80 to urge it toward right against the force of spring 85 thus disengaging pin 79 from hole 81 of the gear 80. Accordingly, the spring 85 quickly returns gear 80, pinion 84 and the minute drum 17 by rotating them through about 360°. Although not described hereinabove, it should be understood that the cam wheels 67 and 56 and the bell shaped cam 72 and the gear 80 should be maintained at such relative positions that above described operation can be performed.

While in the foregoing description, the hour cylinder was rotated intermittently at each one hour, it is also possible to continuously rotate the hour cylinder for 12 hours and then quickly return it as has been described in connection with the minute cylinder.

Further, the cylinders 16 and 17 were allowed to quickly return in the counter-rotational direction by the aid of coil springs potentiated by the rotation of the shafts 62 and 22. Essentially, however, it is necessitated that after reading 12 o'clock or 60 minute position, the righthand ends 14*a* and 15*a* of the shaded areas 14 and 15 shown in FIG. 1 are quickly returned to 0 o'clock or 0 minute position. Accordingly, it is possible to return the cylinders 16 and 17 to the start point by applying the cylinders 16 and 17 with a rotation in their rotational direction. Further, instead of rotatable mounting of the gear 80 to the shaft 77, the gear 76 may be pivoted to the shaft 77. In such a case, the spring 83 may be provided for the gear 76 and the cam 72 may be mounted to the shaft 71 in a reverse fashion in order to assure engagement of the cam 72 with the gear 76.

Figure 8:
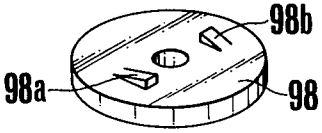
FIG. 8 is a perspective view showing a cam having the same function as the bell shaped cam shown in FIG. 7.

FIG. 8 shows a modified bell shaped cam which comprises a circular disc 98 provided with 180° apart projections 98*a* and 98*b* which function in the same manner as the projections 90 and 91 shown in FIG. 7. Thus, when either one of the projections 98*a* and 98*b* engage gear 80, the gear 80 is disengaged from gear 76.

In the same manner, it is also possible to display second by providing a similar cylinder which is rotated one revolution in one minute.

Instead of arranging the hour, minute and second cylinders in the horizontal position, it is also possible to arrange them in the vertical position.

As above described, the invention provides a novel timepiece in which hour, minute and second, if desired, are displayed in the windows by the shaded or coloured areas of the cylinders so that it is possible to ready read the displayed time. The construction is simple and suitable for mass production. Moreover, it is easy to mount illuminating lamps within the casing. The invention is suitable for use as clocks or radio clocks. In the latter case the dial plate can be used also as the dial plate of the radio receiver.

As above described, as shading with black ink is equivalent to colouring, the term colour used in the claim also covers such shading.

While the invention has been described in terms of some preferred enbodiments thereof, it will be clear that the invention is not limited to these specific embodiments and that many changes and modifications will be obvious to one skilled in the art without departing from the true spirit and scope of the invention as defined in the appended claims.

What is claimed is:

1. A timepiece comprising a casing, an hour cylinder and a minute cylinder contained in said housing, driving means for rotating said cylinder at a constant speed of one revolution every 12 hours for said hour cylinder and one revolution every 60 minutes for said minute cylinder, and a dial plate mounted on said casing, said dial plate being provided with hour and minute windows extending in the axial direction of said hour and minute cylinders, said hour window being parallel with said hour cylinder and being marked with a plurality of digits for displaying hours and said minute window being parallel with said minute cylinder and being marked with a plurality of digits for displaying minutes, the outer periphery of each of said cylinders being divided into two areas by a line inclined at a predetermined angle with respect to the axis of each said cylinders and said two area being colored by different colors, wherein said driving means comprises a first shaft driven at a constant speed by said driving means, a first pinion mounted on said first shaft for driving a second pinion mounted on a second shaft, a third pinion rotatably mounted on said second shaft, a pin and slot connection between said second and third pinions, spring means surrounding said second shaft for normally engaging said pin and slot, a fifth pinion meshing said third pinion for driving said minute cylinder, a third shaft continuously rotated by said first shaft, a first cam wheel mounted on said third shaft, a fourth shaft driven by said third shaft, a second cam wheel cooperating with said first cam wheel, a third cam wheel cooperating with said third pinion, said second and third cam wheels being rotatably mounted on said fourth shaft, spring means interposed between said fourth shaft and said second cam wheel, and means for driving said hour cylinder in accordance with the intermittent rotation of said second cam wheel.

2. The timepiece according to claim 1 wherein said first cam wheel comprises two semicircular discs which are displaced axially of said third shaft, and said second cam wheel comprises a pair of symmetrical sectors which are displaced axially in the same manner as said semicircular discs, whereby said sectors engage inner edges of said semicircular discs, respectively.

3. The timepiece according to claim 1 wherein said third cam wheel takes the form of a bell having two 180° spaced projections adapted to engage one side of said third pinion and two lower portions between said projections.

4. The timepiece according to claim 1 wherein said third cam wheel comprises a circular disc provided with two 180° spaced projections adapted to engage one side of said third pinion.

5. A time piece comprising a casing, an hour cylinder and a minute cylinder contained in said housing, driving means for rotating said cylinders at a constant speed of one revolution every 12 hours for said hour cylinder and one revolution every 60 minutes for said minute cylinder, and a dial plate mounted on said casing, said dial plate being provided with hour and minute windows on one surface thereof extending in the axial direction of said hour and minute cylinders, said hour window being parallel with said hour cylinder and being marked with a plurality of digits for displaying hours and said minute window being parallel with said minute cylinder and being marked with a plurality of digits for displaying minutes, the outer periphery of each of said cylinders being divided into two areas by a line inclined at a predetermined angle with respect to each axis of said cylinders and said two areas being colored by different colors, said inclined line on said hour cylinder compresses a diagonal of a rectangle, and wherein one end of said hour cylinder is extended in the longitudinal direction so as to form an extended end, and a colored triangle is disposed on said hour cylinder in said extended end thereby enabling one to read the time in terms of the time elapsed past 12 o'clock.

* * * * *